US010097938B2

(12) United States Patent
Lee et al.

(10) Patent No.: US 10,097,938 B2
(45) Date of Patent: Oct. 9, 2018

(54) ELECTRONIC DEVICE AND SOUND SIGNAL PROCESSING METHOD THEREOF

(71) Applicant: SAMSUNG ELECTRONICS CO., LTD., Suwon-si, Gyeonggi-do (KR)

(72) Inventors: Jaeseong Lee, Suwon-si (KR); Kyoungho Bang, Seoul (KR); Kyuhan Kim, Suwon-si (KR); Juhwan Woo, Suwon-si (KR); Namil Lee, Suwon-si (KR); Hyunchul Yang, Suwon-si (KR); Hochul Hwang, Yongin-si (KR)

(73) Assignee: SAMSUNG ELECTRONICS CO., LTD., Suwon-si, Gyeonggi-do (KR)

( * ) Notice: Subject to any disclaimer, the term of this patent is extended or adjusted under 35 U.S.C. 154(b) by 0 days.

(21) Appl. No.: 15/607,833

(22) Filed: May 30, 2017

(65) Prior Publication Data

US 2017/0353806 A1 Dec. 7, 2017

(30) Foreign Application Priority Data

Jun. 1, 2016 (KR) ..... 10-2016-0068347

(51) Int. Cl.

| | |
|---|---|
| ***H04R 25/00*** | (2006.01) |
| ***G10L 21/0232*** | (2013.01) |
| ***H04R 1/10*** | (2006.01) |

(52) U.S. Cl.

CPC ..... *H04R 25/70* (2013.01); *G10L 21/0232* (2013.01); *H04R 1/1083* (2013.01); *H04R 25/353* (2013.01); *H04R 25/505* (2013.01); *H04R 2225/43* (2013.01); *H04R 2430/03* (2013.01)

(58) Field of Classification Search

CPC .. H04R 1/1083; H04R 25/353; H04R 25/356; H04R 25/505; H04R 25/70; H04R 2225/43; H04R 2430/03; G10L 21/0232

USPC .... 381/60, 312, 314, 316, 317, 320, 321, 98

See application file for complete search history.

(56) References Cited

U.S. PATENT DOCUMENTS

| | | | | |
|---|---|---|---|---|
| 4,843,623 | A * | 6/1989 | Lafon | H04R 25/353 381/316 |
| 7,248,711 | B2 | 7/2007 | Allegro et al. | |
| 8,031,892 | B2 | 10/2011 | Andersen et al. | |
| 8,107,654 | B2 | 1/2012 | Edwards et al. | |

(Continued)

*Primary Examiner* — Huyen D Le

(74) *Attorney, Agent, or Firm* — Nixon & Vanderhye, P.C.

(57) ABSTRACT

An electronic device and a sound signal processing method for improving sound perception of a hearing-impaired user are provided. The electronic device of the present disclosure includes a sound input unit comprising sound input circuitry configured to detect a sound and to convert the sound into a first sound signal and a processor which is electrically connected to the sound input unit, the processor configured to receive the first sound signal and to perform a predetermined signal processing on the first sound signal to generate a second sound signal, wherein the signal processing includes detecting a frequency band with a level equal to or greater than a predetermined value in a first frequency band above a predetermined cutoff frequency of the first sound signal, generating harmonic signals including a plurality of frequency bins that are identical in level with a signal in the detected frequency band, and overlapping the harmonic signals with the first sound signal.

20 Claims, 15 Drawing Sheets

(56) References Cited

U.S. PATENT DOCUMENTS

| | | | | |
|---|---|---|---|---|
| 9,031,269 | B2 * | 5/2015 | Baumi | H04R 25/353 381/316 |
| 2007/0253585 | A1 * | 11/2007 | Steinbuss | H04R 25/353 381/312 |
| 2008/0254753 | A1 | 10/2008 | Steenstra et al. | |
| 2015/0073784 | A1 | 3/2015 | Gao | |

* cited by examiner

ELECTRONIC DEVICE AND SOUND SIGNAL PROCESSING METHOD THEREOF

CROSS-REFERENCE TO RELATED APPLICATION

This application is based on and claims priority under 35 U.S.C. § 119 to a Korean patent application filed on Jun. 1, 2016 in the Korean intellectual property office and assigned serial number 10-2016-0068347, the disclosure of which is incorporated by reference herein in its entirety.

TECHNICAL FIELD

The present disclosure relates generally to an electronic device and, for example, to an electronic device and sound signal processing method thereof for improving sound perception of a hearing-impaired user.

BACKGROUND

With the increasing use of audio devices, increase of the ratio of the elderly population, and frequent exposure to noisy environments, the hearing-impaired population is increasing. This is spurring the development of electronic devices (e.g., hearing aid) equipped with various functions for assisting hearing-impaired persons.

Typically, hearing-impaired persons may have difficulty in perceiving sounds correctly in a part or the whole of a frequency band. A hearing aid is designed to compensate for a hearing loss by amplifying sounds in a part or the whole of the frequency band audible to the human ear. Conventional electronic devices (e.g., hearing aid) are designed to shift a high frequency band signal downwards in frequency for a high frequency band hearing-impaired user. In this case, the user may hear the unperceivable high frequency band sound within the user's perceivable frequency range, but there is a difference between the real sound and the sound perceived by the user because of a change of signal waveform.

SUMMARY

The present disclosure provides an electronic device and sound signal processing method thereof that is capable processing a sound signal of an unperceivable frequency range of a hearing-impaired user digitally into a signal within the user's perceivable frequency range while minimizing and/or reducing the change of sound waveform.

In accordance with an example aspect of the present disclosure, an electronic device is provided. The electronic device includes: a sound input unit comprising sound input circuitry configured to detect a sound and to convert the sound into a first sound signal and a processor which is electrically connected to the sound input unit, the processor configured to receive the first sound signal and to perform a predetermined signal processing on the first sound signal to generate a second sound signal, wherein the signal processing comprises detecting a frequency band having a level equal to or greater than a predetermined value in a first frequency band above a predetermined cutoff frequency of the first sound signal, generating harmonic signals including a plurality of frequency bins that are identical in level with a signal in the detected frequency band, and overlapping the harmonic signals with the first sound signal.

In accordance with another example aspect of the present disclosure, a sound signal correction method of an electronic device is provided. The sound signal correction method of the present disclosure includes: detecting a first sound signal and generating a second sound signal by performing a predetermined signal processing on the first sound signal, wherein generating the second sound signal includes detecting a frequency band with a level equal to or greater than a predetermined value in a first frequency band above a predetermined cutoff frequency of the first sound signal, generating harmonic signals including a plurality of frequency bins that are identical in level with a signal in the detected frequency band, and overlapping the harmonic signals with the first sound signal.

BRIEF DESCRIPTION OF THE DRAWINGS

The above and other aspects, features and attendant advantages of the present disclosure will be apparent and more readily appreciated from the following detailed description, taken in conjunction with the accompanying drawings, in which like reference numerals refer to like elements, and wherein.

DETAILED DESCRIPTION

Figure 1A:
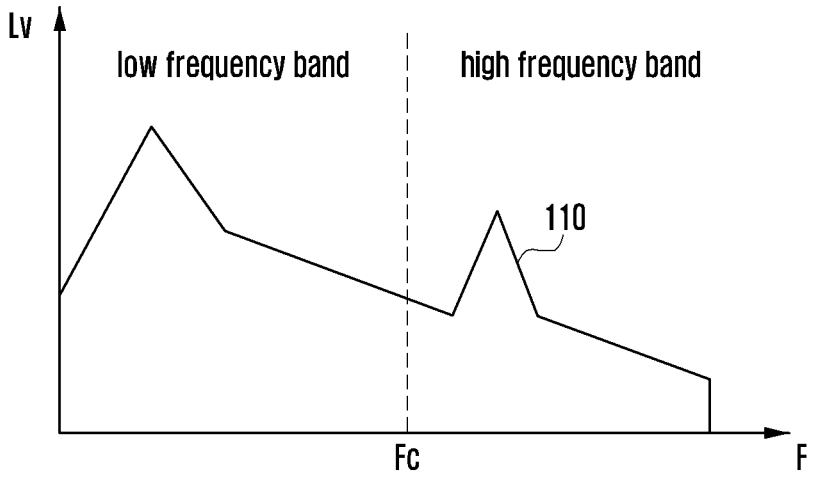
FIGS. 1A and 1B are diagrams illustrating an example waveform of a sound signal.

Various example embodiments of the present disclosure are described in greater detail herein with reference to the accompanying drawings. The example embodiments and terms used herein are not intended to limit the disclosure and it should be understood that the example embodiments include all changes, equivalents, and substitutes within the spirit and scope of the disclosure. Throughout the drawings, like reference numerals refer to like components. As used herein, the singular forms "a", "an," and "the" are intended to include the plural forms as well, unless the context clearly indicates otherwise. In various embodiments of the present disclosure, the expression "or" or "at least one of A or/and B" includes any or all of combinations of words listed together. For example, the expression "A or B" or "at least A or/and B" may include A, may include B, or may include both A and B. The expressions "1", "2", "first", or "second" used in various embodiments of the present disclosure may modify various components of the various embodiments, but they do not limit the corresponding components. In addition, throughout the specification, when it is describe that a part (e.g., first part) is "connected (functionally or communicationally) to" another part (e.g., second part), this includes not only a case of "being directly connected to" but also a case of "being indirectly connected to" by interposing another device (e.g., third part) therebetween.

In the following description, the expression "configured to ~" may be interchangeably used with the expressions "suitable for ~", "having a capability of ~", "changed to ~", "made to ~", "capable of ~", and "designed for" in hardware or software. The expression "device configured to ~" may denote that the device is "capable of ~" with other devices or components. For example, when it is mentioned that a processor is configured to perform A, B, and C, it may be understood that the processor (e.g., CPU and application processor) is capable of performing corresponding operations by executing software programs dedicated to the corresponding operations.

An electronic device according to various example embodiments of the preset disclosure may be one or more of a smart phone, a tablet Personal Computer (PC), a mobile phone, a video phone, an e-book reader, a desktop PC, a laptop PC, a netbook computer, a Personal Digital Assistant (PDA), a portable Multimedia Player (PMP), an MP3 player, a medical device, a camera, and a wearable device, or the like, but is not limited thereto. The wearable device may include one of an appcessory type device (e.g., a watch, a ring, a bracelet, an anklet, a necklace, glasses, contact lens, and Head-Mounted-Device (HMD), a textile or clothes-integrated device (e.g., electronic clothes), a body-attached device (e.g., skin pad and tattoo), and a bio-implemented circuit, or the like, but is not limited thereto. According to various example embodiments, the electronic device may be one of a television (TV), a Digital Video Disk (DVD) player, an audio player, an air conditioner, a cleaner, an oven, a microwave oven, a washing machine, an air cleaner, a set-top box, a TV box (e.g., Samsung HomeSync™, Apple TV™, and Google TV™), game consoles (e.g., Xbox™ and PlayStation™), an electronic dictionary, an electronic key, a camcorder, and an electronic frame, or the like, but is not limited thereto.

According to various example embodiments, the electronic device may be one of a medical device (such as portable medical sensors (including a glucometer, a heart rate sensor, a tonometer, and a body thermometer), a Magnetic Resonance Angiography (MRA) device, a Magnetic Resonance Imaging (MRI) device, a Computed Tomography (CT) device, a camcorder, and a microwave scanner), a navigation device, a Global Navigation Satellite System (GNSS), an Event Data Recorder (EDR), a Flight Data Recorder (FDR), an automotive infotainment device, marine electronic equipment (such as a marine navigation system and gyro compass), aviation electronics (avionics), an automotive head unit, an industrial or household robot, an Automatic Teller Machine (ATM), a Point Of Sales (POS) terminal, and an Internet-of-Things (IoT) device (such as an electric bulb, sensor, sprinkler system, fire alarm system, temperature controller, street lamp, toaster, fitness equipment, hot water tank, heater, and boiler), or the like, but is not limited thereto. According to an example embodiment of the present disclosure, examples of the electronic device may include furniture, a building/structure, a part of a vehicle, an electronic board, an electronic signature receiving device, a projector, and a sensor (such as water, electricity, gas, and electric wave meters), or the like, but is not limited thereto. According to various embodiments of the present disclosure, the electronic device may be flexible or a combination of at least two of the aforementioned devices. According to an embodiment of the present disclosure, the electronic device is not limited to the aforementioned devices. In the present disclosure, the term "user" may denote a person who uses the electronic device or a device (e.g., artificial intelligent electronic device) which uses the electronic device.

The term "module" according to the embodiments of the disclosure, may, for example, refer to, but is not limited to, a unit of one of software, hardware, and firmware or any combination thereof. The term "module" may be used interchangeably with the terms "unit," "logic," "logical block," "component," or "circuit." The term "module" may denote a smallest unit of a component or a part thereof. The term "module" may be the smallest unit of performing at least one function or a part thereof. A module may be implemented mechanically or electronically. For example, a module may include at least one of a dedicated processor, a CPU, an Application-Specific Integrated Circuit (ASIC) chip, Field-Programmable Gate Arrays (FPGAs), and Programmable-Logic Device known or to be developed for certain operations. According to various embodiments of the present disclosure, the devices (e.g., modules or their functions) or methods (e.g., operations) may be implemented by computer program instructions stored in a computer-readable storage medium.

According to various embodiments of the present disclosure, an electronic device may be a hearing aid. As known in the art, the hearing aid is designed to amplify a signal in a part or the whole of a frequency band to a predetermined level in order for a hearing-impaired user to perceive the corresponding sound. Various embodiments of the present disclosure are directed to an electronic device as a hearing aid or a hearing aid function-equipped multifunctional device such as a smartphone and a tablet Personal Computer (PC). However, the electronic device is not limited to those specified in the embodiments, and it may be any type of electronic device capable of processing sound signals.

In the following description, the first sound signal may be a digital signal obtained by converting an analog sound collected by a sound input unit (e.g., including sound input circuitry) of an electronic device or a sound signal stored in the electronic device or received from an external device. In the following description, the second sound signal may be a signal obtained by correcting a high frequency band signal as a signal processing result of a processor of the electronic device.

In the following description, the term "cutoff frequency (fc)" may refer, for example, to a maximum frequency value of a sound which the user of the electronic device can perceive correctly. As known in the art, the higher the sound's pitch is, the higher the frequency of sound. A hearing-impaired user of the electronic device may not perceive a sound signal on a frequency equal to or higher than the cutoff frequency. For example, a fricative sound such as [s] and [ʃ] is a high-frequency phoneme produced in the frequency range of 4 kHz to 7 kHz, although there is variation depending on the speaker. If the upper limit of a user's hearing ability is 4 kHz, the user cannot perceive the sound signal of a higher frequency above 4 kHz. For this reason, it is necessary to determine a hearing-impaired user's cutoff frequency by analyzing the user's hearing characteristics through various pre-tests.

Various example embodiments of the present disclosure are described hereinafter with reference to FIGS. 1A to 8.

Figure 1B:
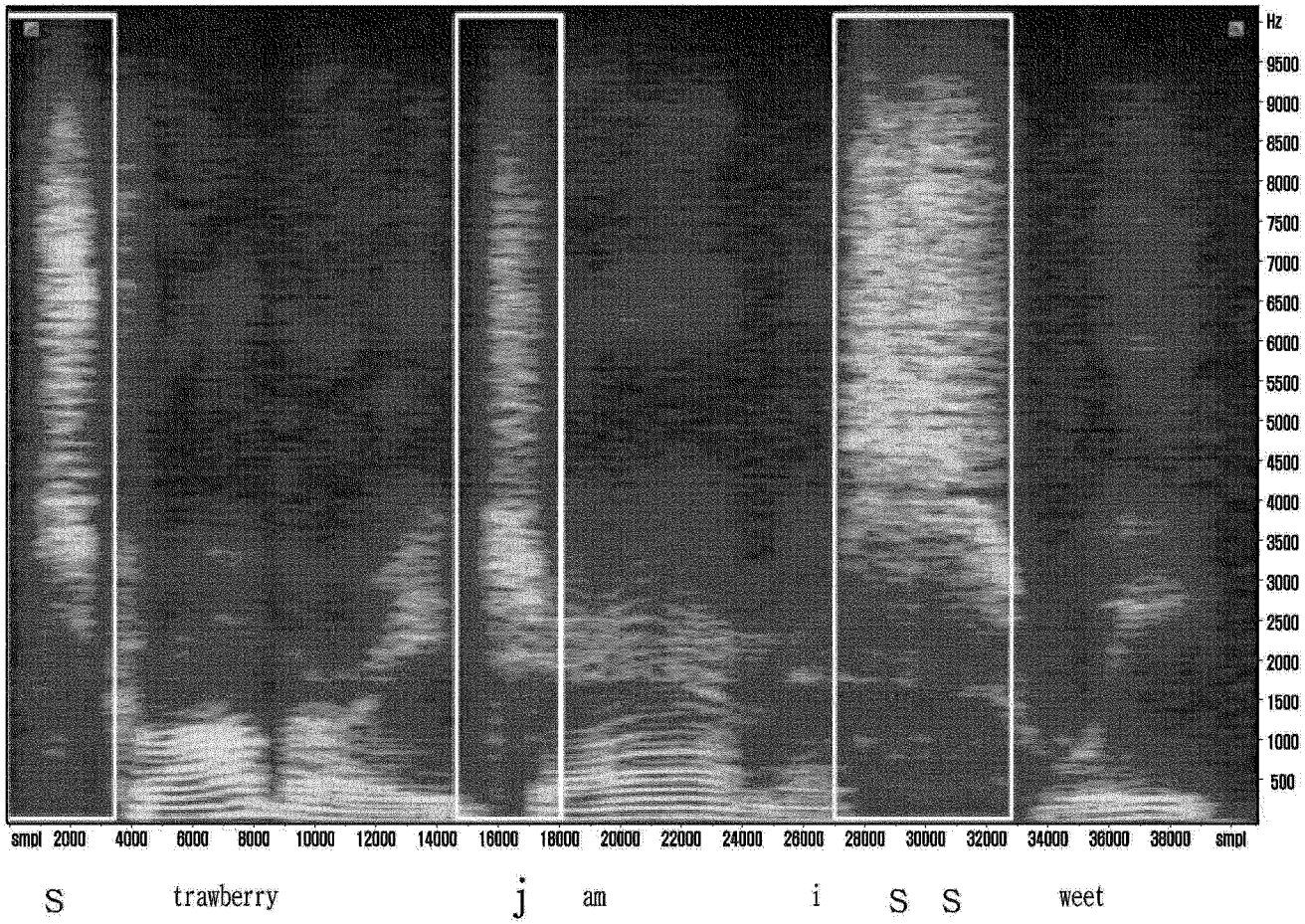

FIGS. 1A and 1B are diagrams illustrating an example waveform of a sound signal.

FIG. 1A is a graph illustrating an amplitude curve of the first sound signal in the frequency domain according to an embodiment of the present disclosure. In FIG. 1A, the horizontal axis denotes frequency, and the vertical axis denotes a signal level or amplitude. The graph of FIG. 1A may illustrate the size of a frequency component at a specific time or during a time period.

As illustrated in the drawing, the first sound signal is divided into a low frequency band and a high frequency band by a cutoff frequency (fc). As described above, the cutoff frequency may be an upper frequency limit of sound perceivable by the user of the electronic device, and the cutoff frequency value is determined statistically.

In FIG. 1A, the high frequency band has a part of high frequency as denoted by reference number 110. Such a component with a high signal level is likely to be a meaningful component in the real sound, but the user of the electronic device may not perceive the high-level signal component because the high-level signal component is within the high frequency band above the cutoff frequency. Such a signal component is likely to be a fricative component as illustrated in FIG. 1B.

FIG. 1B is a graph illustrating the signal level of the first sound signal in the time domain.

FIG. 1B illustrates change in frequency of a sound signal, as time goes by, when the saying "Strawberry jam is sweet" made by somebody is input to the electronic device. In FIG. 1B, the horizontal axis denotes time, and the vertical axis denotes frequency. When a specific sound having a high frequency component is input, the frequency level may increases as shown in the graph.

As shown in the drawing, at the instants of input of the sound [s] of the word "strawberry", [j] of the word "jam", and [s] of the word "sweet", there are high frequency components.

Descriptions are made of the methods for an electronic device to correct the fricative components (e.g., component denoted by reference number 110 in FIG. 1A and components corresponding to [s] and [j] in FIG. 1B) to low frequency band components which the user can perceive.

Figure 2:
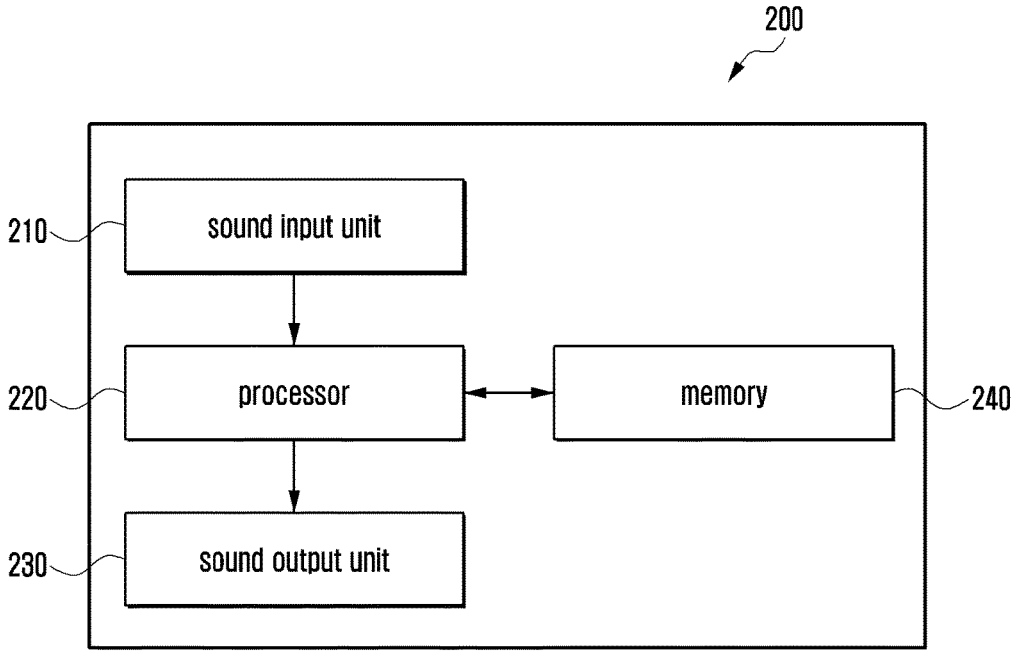
FIG. 2 is a block diagram illustrating an example configuration of an electronic device according to various example embodiments of the present disclosure.

FIG. 2 is a block diagram illustrating an example configuration of an electronic device according to various example embodiments of the present disclosure.

As illustrated in FIG. 2, the electronic device 200 includes a sound input unit (e.g., including sound input circuitry) 210, a processor (e.g., including processing circuitry) 220, a sound output unit (e.g., including sound output circuitry) 230, and a memory 240. It should be noted that various embodiments of the present disclosure can be implemented by removing or replacing at least one of the above components with a substitute.

The sound input unit 210 may include various sound input circuitry and detect a sound and convert the sound to a first sound signal. According to various embodiments of the present disclosure, the sound input unit 210 collects sounds around the electronic device 200 to acquire a sound signal in an analog format, and converts the analog signal to a digital signal. In order to accomplish this, the sound input unit 210 may include various circuitry, such as, for example, and without limitation, an Analog-to-Digital (A/D) converter, which can be implemented in hardware and/or software. The sound input unit 210 may be implemented in the form of a well-known device such as a microphone.

According to an example embodiment, the first sound signal may be a sound signal stored in the memory 240 of the electronic device 200 or received from an external device. For example, the electronic device 200 may amplify and/or convert the sound signal generated by the electronic device 200 and the external device as well as the sound signal collected by the sound input unit 210. According to an embodiment, the electronic device 200 may include a radio communication module (not shown) to receive sound signals from the external device.

The memory 240 may include a well-known volatile memory and/or non-volatile memory without restriction in the implementation thereof. The memory 240 may be electrically connected to the processor 220 and store various instructions executable by the processor 220. Such instructions may include control commands for arithmetical and logical computation, data transfer, and input/output operation. The instructions of the processor 220 to be described hereinbelow may be carried out by loading the instructions stored in the memory 240.

According to an embodiment, the memory 240 may store a cutoff frequency value. As described above, the cutoff frequency may be an upper frequency limit of the sound that the user of the electronic device 200 can correctly perceive and may be predetermined by analyzing the hearing characteristics of the user.

The processor 220 may include various processing circuitry and is configured to control the components of the electronic device 200 and perform communication-related operations and data processing. The processor 220 may be electrically and/or functionally connected to internal components (such as the sound input unit 210, the sound output unit 230, and the memory 240) of the electronic device 200.

The processor 220 may receive the first sound signal output from the sound input unit 210 and perform a predetermined signal processing on the first sound signal to generate a second sound signal.

According to various embodiments, the processor 220 may amplify the signal level of a part or the whole of the frequency band of the first sound signal to generate the second sound signal.

The processor 220 may also detect a fricative component in a high frequency band above the cutoff frequency of the first sound signal and perform signal processing to correct the fricative component to a signal within the low frequency band below the cutoff frequency. In order to accomplish this, the processor 220 may perform a detection routine for detecting a frequency band having a level higher than a predetermined level in the high frequency band above the cutoff frequency, a harmonic generation routing for generating harmonic signals including a plurality of frequency bins having the same level as the signal of the detected frequency band, and an envelope shaping routine for overlapping the harmonic signals with the first sound signal and adjusting the levels of the frequency bins. The signal processing operation of the processor 220 is described in greater detail below with reference to FIGS. 3 to 6.

The second sound signal generated as a result of the signal processing operation of the processor 220 may be output to the sound output unit 230, which may include various sound output circuitry and is electrically connected to the processor 220. According to an embodiment, the sound output unit 230 may include sound output circuitry, such as, for example, and without limitation, a Digital-to-Analog (D/A) converter for converting the second sound signal as a digital signal to an analog signal. The sound output unit 230 may be implemented in the form of a well-known device such as a speaker outputting sound, a receiver, and an earphone.

The user who cannot perceive signals in the high frequency band above the cutoff frequency may perceive the fricative component of the second sound signal output from the sound output unit 230.

Although not illustrated in FIG. 2, the electronic device 200 may further include a communication module including various communication circuitry for supporting at least one of, for example, and without limitation, cellular, Wi-Fi, and Bluetooth communications, an input device such as a key input device and a touch panel, a display, a battery, and a Power Management Module (or Power Management Integrated Circuit (PMIC)).

Figure 3:
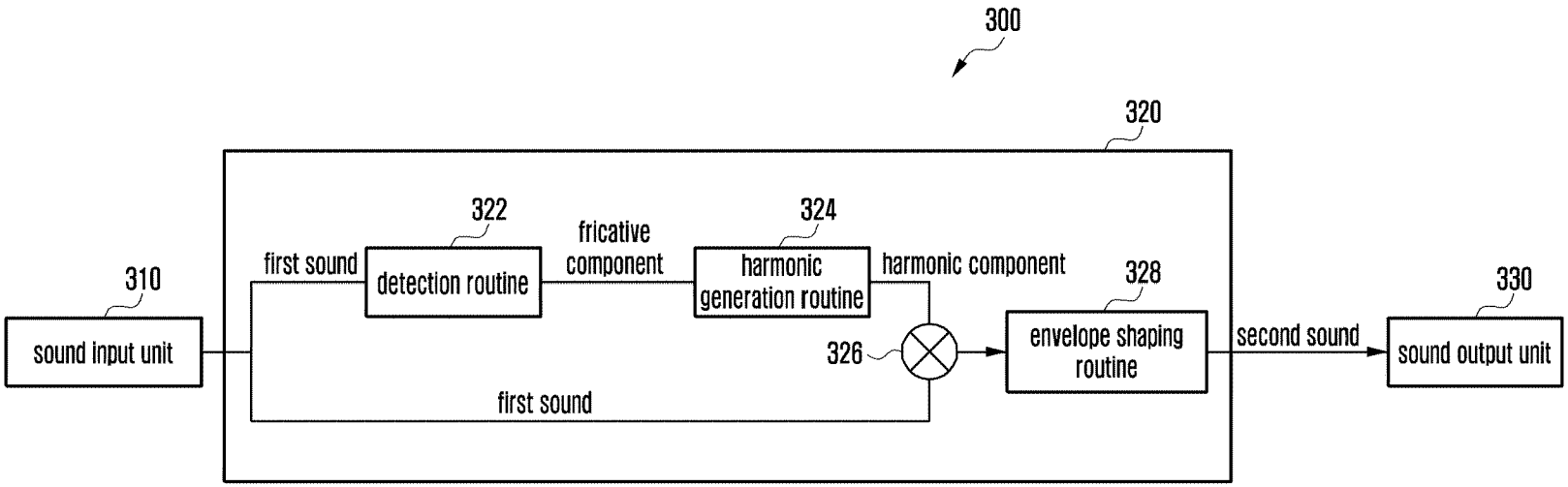
FIG. 3 is a block diagram illustrating an example configuration of an electronic device according to various example embodiments of the present disclosure.

FIG. 3 is a block diagram illustrating an example configuration of an electronic device according to various example embodiments of the present disclosure.

As illustrated in FIG. 3, the first sound signal output from the sound input unit (e.g., including sound input circuitry) 310 may be input to the processor (e.g., including processing circuitry) 320.

The processor 320 may perform a detection routing 322 for detecting the first sound signal. The processor 320 may detect a frequency band having a level higher than a predetermined level in the first frequency band (or high frequency band) above a predetermined cutoff frequency of the first sound signal in the detection routing 322. Here, the frequency band having a level higher than a predetermined level in the first frequency band may be the frequency band of the fricative component represented by pronunciation symbols such as [s] and [ʃ]. According to various embodiments, the processor 320 may detect a frequency bin of a sub-band with the highest power among a plurality of sub-bands (e.g., sub-bands with a bandwidth of 150 Hz) constituting the frequency band of the first sound signal.

As a result of the detection routine 322, if no fricative component is detected, the processor 320 may skip the harmonic generation routing 324 and envelope shaping routing 328 and amplify the signal level in a part or the whole of the frequency band of the first sound signal to generate the second sound signal. The fricative component detection routine 322 is described later in greater detail below with reference to FIGS. 4A and 4B.

The processor 320 may generate harmonic signals (h1 to hn) including a plurality of frequency bins. The frequency bins may have a predetermined period in the frequency band and appear in a part or the whole of the frequency band. The signal level of each frequency bin may have the same level as the signal of the frequency band (fricative component) detected in the detection routine 322 or be substantially identical with a level having a tolerable difference.

The processor 320 may overlap the generated harmonic signals with the first sound signal as denoted by reference number 326. As described above, since the level of each frequency bin of the harmonic signal is substantially identical with the fricative component, some frequency bins may have a level higher than the first sound signal of same frequency band.

The processor 320 may perform the envelop shaping routine 328 on the overlapped signal. The processor 320 may adjust the level of at least one frequency bin of the high frequency band (or first frequency band) among the plural frequency bins included in the harmonic signals so as to be equal to the level of the first sound signal in the same frequency band. As a consequence, each frequency bin of the harmonic signal may be maintained as overlapped in the low frequency band below the cutoff frequency and may become equal to or lower than the level of the first sound signal as the original signal.

The signal before performing the envelop shaping routine 328 thereon may have harmonic signals with a level higher than that of the first sound signal; thus, the input sound may be distorted. According to various embodiments of the present disclosure, the level of the harmonic signal is adjusted to be lower than that of the first sound signal in the high frequency band through the envelope shaping routine 328, thereby making it possible for the user to perceive the fricative component of the high frequency band while minimizing distortion of the input sound.

The second sound signal generated as a result of performing the envelope shaping routine 328 may be output to the sound output unit 330. The sound output unit 330 may output the second sound signal.

Figure 4A:
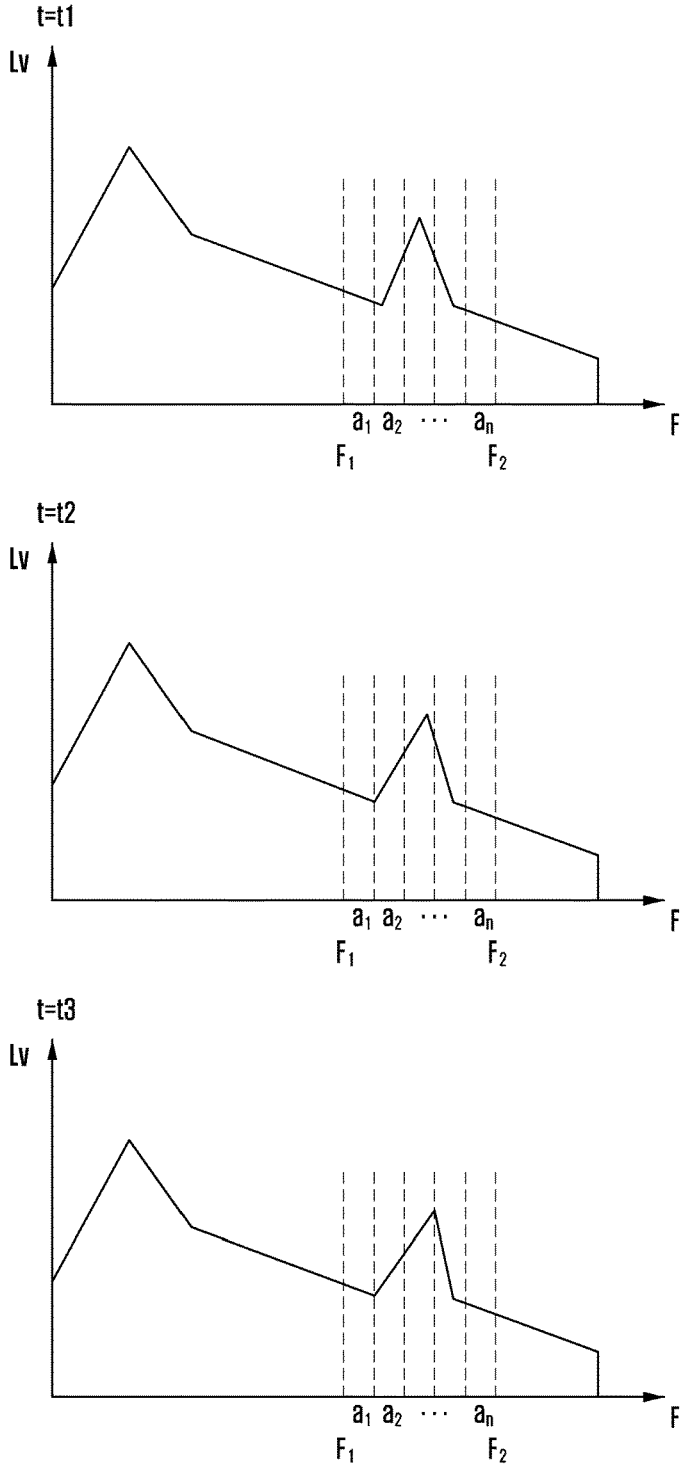
FIGS. 4A and 4B are graphs illustrating an example method for detecting fricative components according to various example embodiments of the present disclosure.
Figure 4B:
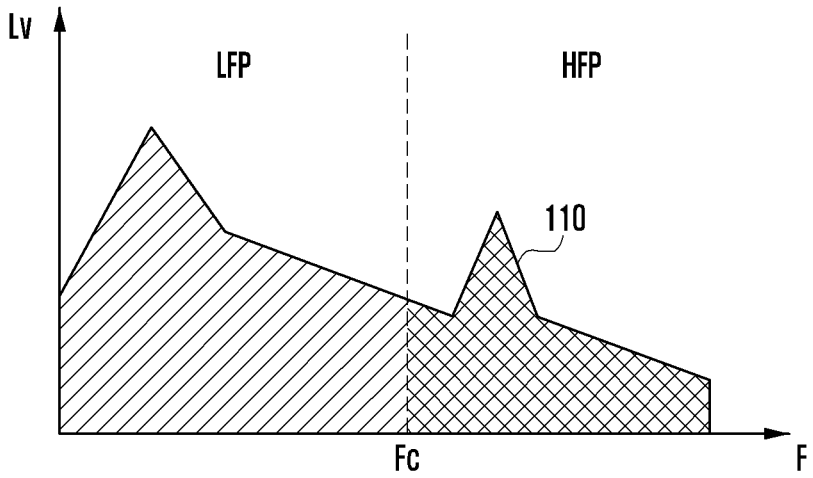

FIGS. 4A and 4B are graphs illustrating an example method for detecting fricative components according to various example embodiments of the present disclosure.

According to various embodiments of the present disclosure, the processor (e.g., processor 220 of FIG. 2 and processor 320 of FIG. 3) may detect a harmonic component in the first sound signal and perform the above-described signal processing routines (e.g., the detection routine, the harmonic generation routine, and the envelope shaping routine) only when a fricative component exists. Assuming that presence of an indicative component is indicative by the fact that the flatness of the frequency spectrum in a specific band of the first sound signal is less than a predetermined threshold value, the processor may determine the presence of a fricative component when a ratio of the power value of a frequency signal in a specific sensing band (e.g., frequency band between 4 kHz and 7 kHz) to the power value of a frequency signal in a band below the sensing band is greater than a predetermined threshold, and perform the above-described signal processing procedure.

FIGS. 4A and 4B relate to a method for detecting a fricative component and illustrate example graphs explaining how to detect a flatness of a frequency spectrum and to compute a power value.

FIG. 4A illustrates graphs of example frequency signal level curves at each of time t1, t2, and t3. Here, times t1, t2, and t3 may be specific time points or time periods. Although three time points or time periods are indicated in FIG. 4A for convenience of explanation, more than three signal spectrums can be used.

The processor may divide a predetermined sensing band into a plurality of sub-bands. Here, the sensing band is a frequency band (e.g., frequency band between 4 kHz and 7 kHz) in which the fricative sounds [s] and [ʃ] are detected. The sensing band may be determined by measuring the frequency band in which the fricative sounds appear regardless of the characteristics of the user of the electronic device, while the cutoff frequency is determined, as described above, according to the characteristics of the user. According to an embodiment, the sub-bands may have the same bandwidth of 100 to 150 Hz.

The processor may divide the frequency spectrum at each of the time points t1, t2, and t3 into a plurality of sub-bands. As illustrated in FIG. 4A, the frequency spectrum is divided into al to an at time t=t1, b1 to bn at time t=t2, and c1 to cn at time t=t3. Here, an, bn, and cn may denote the same frequency band.

The processor may determine (e.g., calculate) an arithmetic mean and a geometric mean using the signal level in each frequency sub-band at time t=t1, t=t2, and t=t3. The arithmetic mean and geometric mean of the nth sub-band may be calculated as (an+bn+cn)/3 and (an*bn*cn)^(⅓), respectively, where an, bn, and cn may denote mean values of the respective sub-bands (e.g., ∫(an/bandwidth of an))df).

If the calculated ratio between the geometric mean and the arithmetic means (geometric mean/arithmetic mean ratio) is less than a predetermined value (geometric mean/arithmetic mean ratio<α), the processor determines that the flatness is less than the threshold value and thus checks for the presence of a fricative component in the corresponding sub-band.

If it is determined through the flatness calculation that the fricative component exists, the processor may calculate power values in the sensing band and a frequency band below the sensing band.

With reference to FIG. 4B, the frequency band is divided into two parts by the lower limit value of the sensing band (e.g., 4 kHz for the sensing band between 4 kHz and 7 kHz), i.e., low frequency band below the lower limit of the sensing band and high frequency band above the lower limit of the sensing band. The processor calculates a Low Frequency Power (LFP) of the low frequency band and a High Frequency Power (HFP) of the high frequency band.

If the lower limit of the sensing band is 4 kHz, the power values may be calculated by the following equations.

$$LFP=\int_0^{4\ kH} X(f)^2 df, HFP=\int_{4\ kH}^{\infty} X(f)^2 df$$

In the equations, the LFP may be calculated as a power value in the frequency band between 0 and 4 kHz as the lower limit of the sensing band, and the HFP as a power value in the frequency band between 4 kHz as the low limit of the sensing band and ∞. Although the HFP is defined as the power value in the range between 4 kHz and ∞, it may be replaced by a Band Frequency Power (BFP) in the sensing band (between 4 kHz and 7 kHz) because the signal level of the sound signal is low in the range above 7 kHz.

If the ratio between the power value of the sensing band (or high frequency band) and the power value of the low frequency band is greater than a threshold value (HFP/LFP>β), the processor determines the presence of a fricative component and performs a signal processing for correcting the fricative component. If the power of the high frequency band is high, this means that the sound signal has many high frequency components at the corresponding time point (or during the corresponding time period); thus, it is necessary to correct the high frequency components to output a sound audible to the user.

In conventional electronic devices, attempts are made to modify the high frequency components without calculation of the ratio of the high frequency components to the whole of the frequency band of the signal or without the above-described flatness calculation and power value calculation. This method distorts the signal significantly, resulting in a large difference between the original sound and the output sound. The sound signal processing methods according to various embodiments of the present disclosure are capable of allowing the hearing-impaired user to perceive fricative components while minimizing change in the original sound.

FIGS. 5A, 5B, 5C and 5D are graphs illustrating an example method for correcting a sound signal according to various example embodiments of the present disclosure. The operations of the processor to be described with reference to FIGS. 5A and 5B may be performed when a fricative component is detected as described with reference to FIGS. 4A and 4B.

Figure 5A:
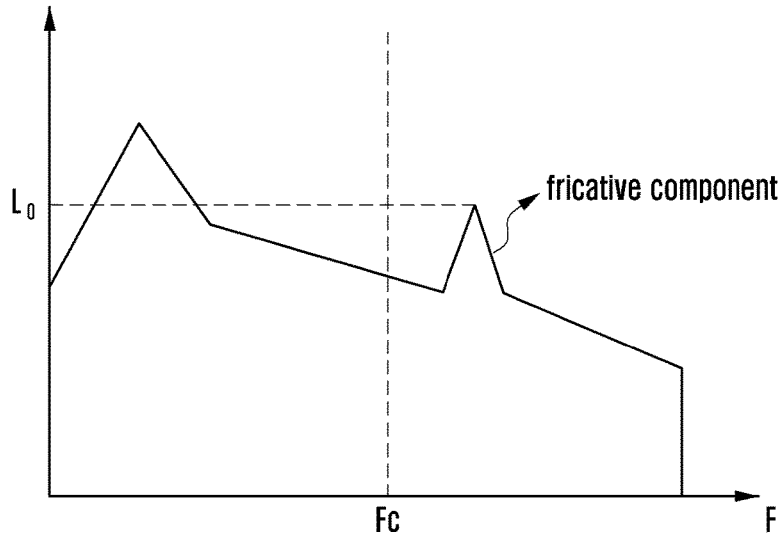
FIGS. 5A, 5B, 5C and 5D are graphs illustrating an example method for correcting a sound signal according to various example embodiments of the present disclosure.

FIG. 5A illustrates the first sound signal.

There may be a fricative component in a frequency band above a cutoff frequency as shown in the drawing, and the signal level of the fricative component is given as L0.

The processor (e.g., processor 220 of FIG. 2 and processor 320 of FIG. 3) of the electronic device may detect a fricative component in the detection routine (as denoted by reference number 322 of FIG. 3). For example, it may be possible to regard a frequency component having a flatness calculated as described with reference to FIG. 4A among the frequency components with a signal level greater than a predetermined level in the high frequency band as a fricative component.

Figure 5B:
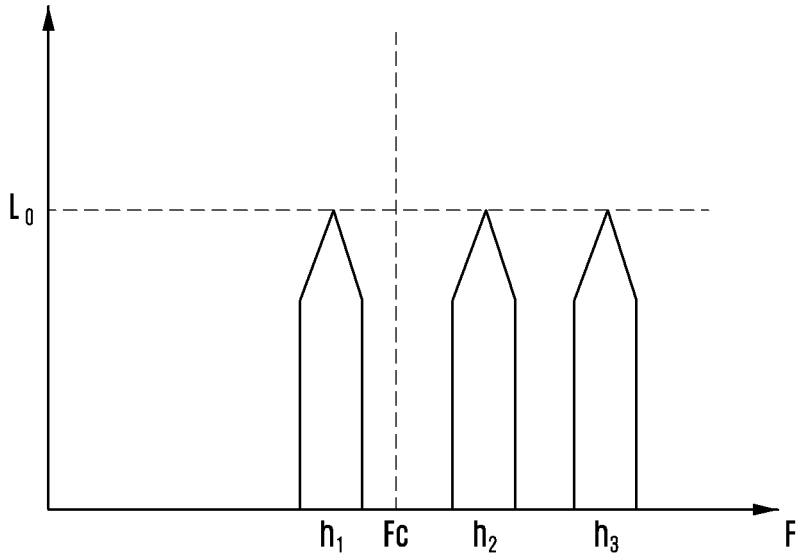

FIG. 5B illustrates harmonic signals.

The processor may generate harmonic signals h1 to hn (h1 to h3 in FIG. 5B) including a plurality of frequency bins in the harmonic generation routine (as denoted by reference number 324 of FIG. 3). Each frequency bin may have a predetermined period in the frequency band and appear in a part or the whole of the frequency band. The signal levels of the frequency bins may have a substantially identical level and may be equal to L0 as the signal level of the fricative component.

Figure 5C:
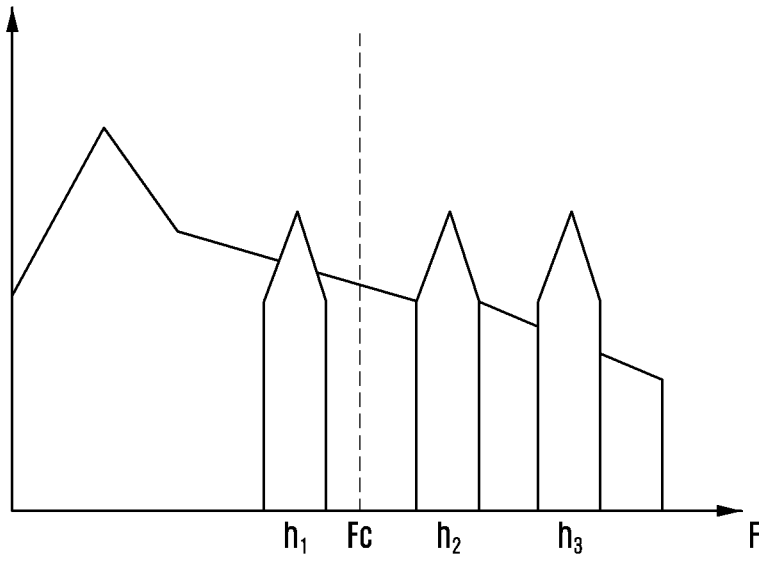

FIG. 5C illustrates the overlap of the first sound signal and the harmonic signals.

The processor may overlap the generated harmonic signals with the first sound signal (as denoted by reference number 326 of FIG. 3). As shown in the drawings, the signal levels of the harmonic signals h1, h2, and h3 may be higher than those of the first sound signal in the same frequency band.

Figure 5D:
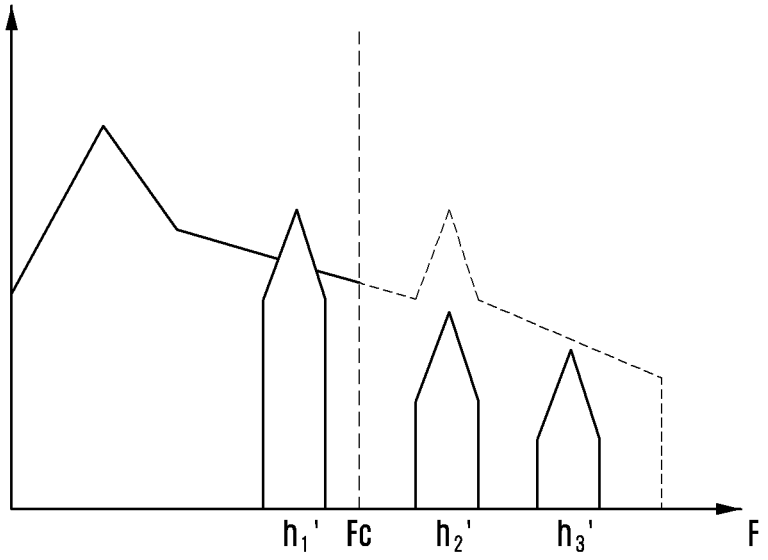

FIG. 5D illustrates the second sound signal after the envelop shaping routine is performed.

The processor may adjust the level of at least one frequency bin of the high frequency band (or first frequency band) among the plural frequency bins included in the harmonic signals so as to be equal to the level of the first sound signal in the same frequency band.

As illustrated in FIG. 5D, the frequency bins h2 and h3 in the high frequency band may be adjusted to h2' and h3' according to the level of the first sound signal. As a consequence, each frequency bin of the harmonic signal may be maintained as overlapped in the low frequency band below the cutoff frequency (e.g., h1') and may become equal to or lower than the level of the first sound signal as the original signal (e.g., h2 and h3).

The second sound signal generated from the first sound signal through the signal processing procedure as described with reference to FIGS. 5A to 5D may be output through a sound output unit (sound output unit 230 of FIG. 2 or sound output unit 330 of FIG. 3).

Figure 6A:
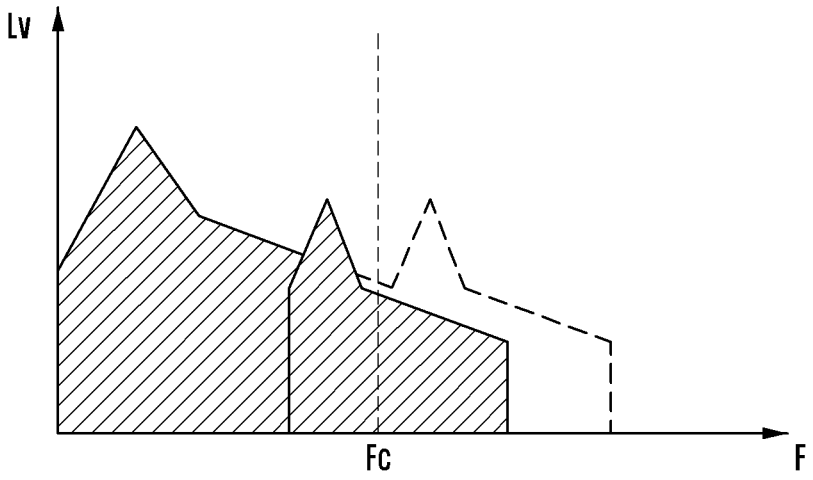
FIGS. 6A, 6B and 6C are diagrams illustrating example fricative component correction procedures according to various example embodiments of the present disclosure.
Figure 6B:
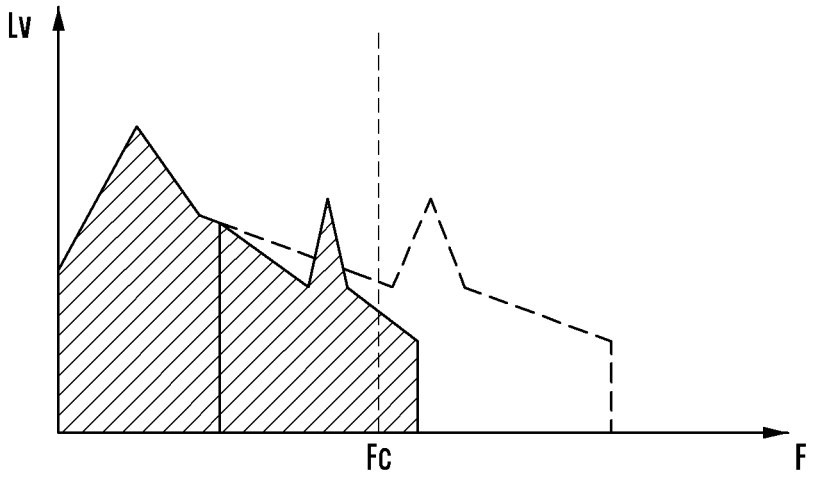
Figure 6C:
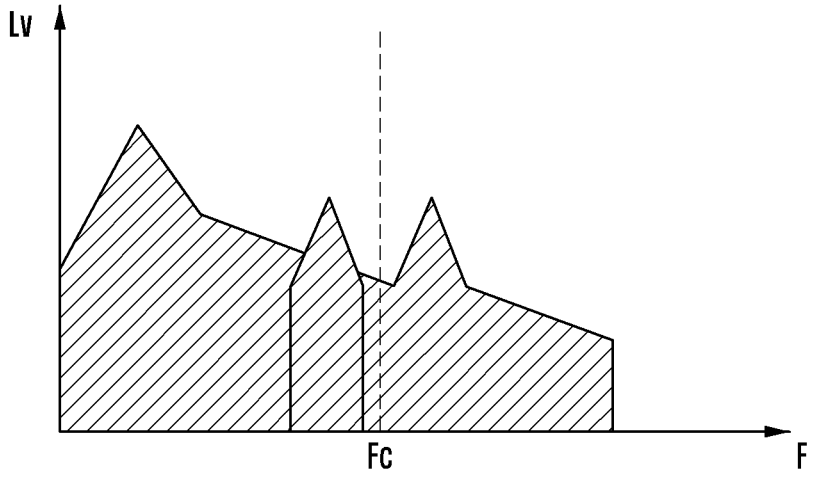

FIGS. 6A, 6B and 6C are diagrams illustrating example fricative component correction procedures according to various example embodiments of the present disclosure. The following descriptions are made based on research conducted with respect to the embodiments described with reference to FIGS. 2 to 5 and thus should not be construed as a conventional technology.

As illustrated in FIG. 6A, the electronic device may shift a high frequency band having a fricative component to a low frequency band in the frequency spectrum. As a consequence, the fricative component may be shifted to the low frequency band below the cutoff frequency.

In comparison to the embodiments of FIGS. 2 to 5, this embodiment has a drawback of causing significant distortion of the real sound because the signal level varies even in the low frequency band that is independent of the fricative component and the change in the high frequency band is relatively large.

As illustrated in FIG. 6B, the electronic device may adjust a high frequency band signal in a frequency band above a reference frequency determined based on a specific frequency of a low frequency band in such a way of compressing the signal according to the frequency. It is inevitable that this embodiment also causes a relatively large distortion to the original sound.

As illustrated in FIG. 6C, the electronic device may insert a frequency bin identical with the fricative component in the low frequency band. This embodiment is advantageous in terms of causing relatively low sound distortion because the high frequency component signal is maintained, but it has a drawback of causing distortion of the fricative component, when one frequency bin is inserted, in comparison with the embodiments of FIGS. 2 to 5 in which harmonic signals with a predetermined period are inserted.

According to various example embodiments of the present disclosure, the electronic device may include a sound input unit comprising sound input circuitry which detects a sound and converts the sound to a first sound signal, and a processor which is electrically connected to the sound input unit, and configured to receive the first sound signal and which is configured to perform a predetermined signal processing procedure on the first sound signal to generate a second sound signal, and the signal processing procedure includes detecting a frequency band having a level equal to or greater than a predetermined value in the first frequency band above a predetermined cutoff frequency of the first sound signal, generating harmonic signals including a plurality of frequency bins with the same level as the signal in the detected frequency band, and overlapping the harmonic signals with the first sound signal.

According to various embodiments, at least one of the plural frequency bins included in the harmonic signals may be present in a second frequency band below the cutoff frequency.

According to various embodiments, the signal processing procedure performed by the processor may further include adjusting the level of at least one frequency bin belonging to the first frequency band among the plural frequency bins included in the harmonic signals to the level of the first sound signal in the same frequency band.

According to various embodiments, the processor performs the signal processing procedure when a fricative component is present in the first sound signal, and checking for presence of the fricative component includes dividing a sensing band predetermined in the first sound signal into a plurality of sub-bands, calculating flatness of the sub-bands, and calculating power values of the sensing band and a frequency band below the sensing band.

According to various embodiments, the processor may determine the presence of the fricative component and perform the signal processing procedure when the flatness is less than a threshold value and a ratio between the power value of the sensing band and the power value of the frequency band below the sensing band is greater than a threshold value.

According to various embodiments, the sensing band is a frequency band between 4 kHz and 7 kHz.

According to various embodiments, the electronic device further includes a memory, which stores the cutoff frequency determined according to hearing characteristics of the user.

According to various embodiments, the electronic device further includes a sound output unit which is electrically connected to the processor and outputs the second sound signal.

According to various embodiments, the electronic device may be configured to output the second sound signal for compensating the first sound signal for hearing impairment of the user.

Figure 7:
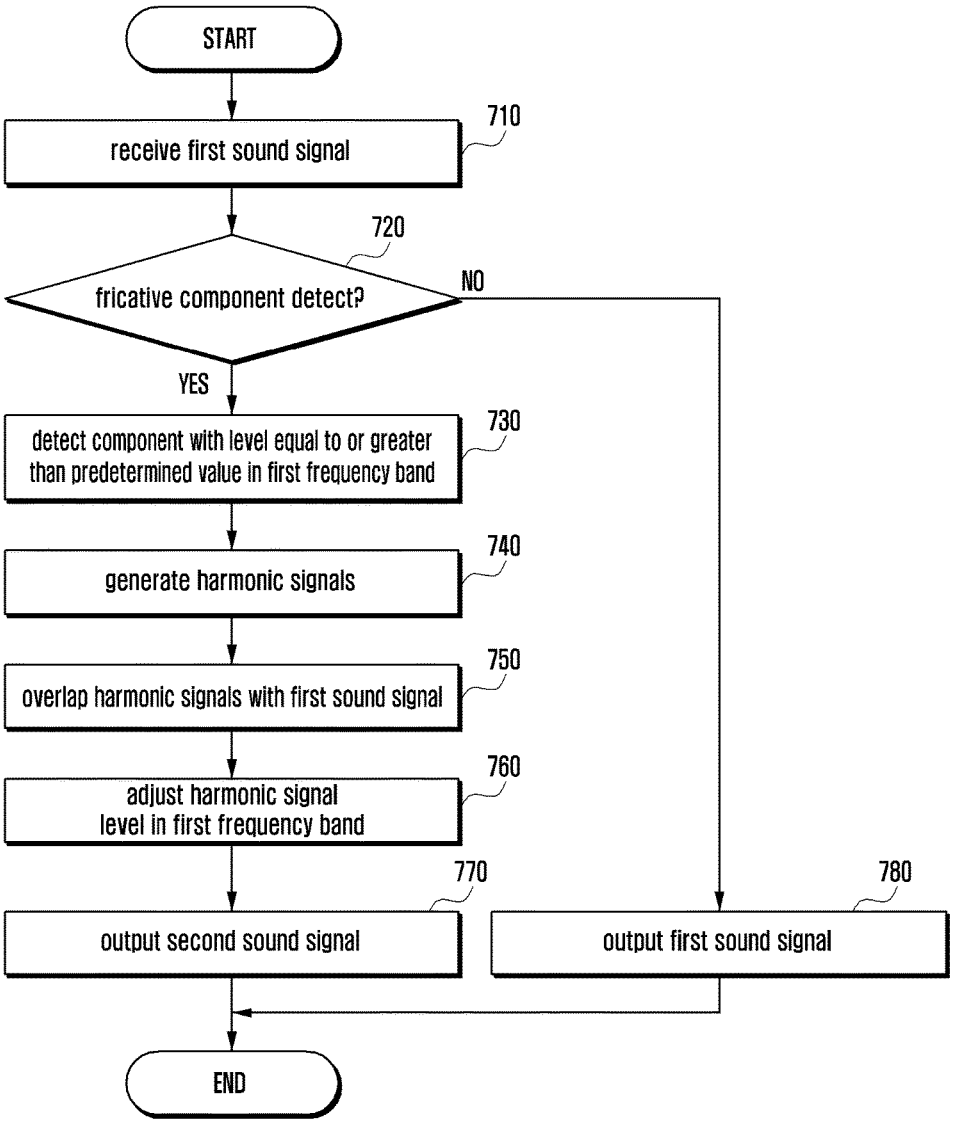
FIG. 7 is a flowchart illustrating an example sound signal correction method according to various example embodiments of the present disclosure.

FIG. 7 is a flowchart illustrating an example sound signal correction method according to various example embodiments of the present disclosure.

The sound signal correction method may be performed by the electronic device 200 of FIG. 2 and/or the electronic device 300 of FIG. 3, and detailed descriptions of technical features that have been made above are omitted herein.

At step 710, the processor (e.g., processor 220 of FIG. 2 and/or processor 320 of FIG. 3) may receive the first sound signal output from the sound input unit.

At step 720, the processor may detect a fricative component. Step 720 is described in greater detail below with reference to FIG. 8.

If no fricative component is detected at step 720 or the high frequency band power value of the first sound signal is low, the procedure goes to step 780. At step 780, the processor may output the first sound signal with or without amplifying a specific frequency band or the whole frequency band thereof.

If a fricative component is detected at step 720, at step 730 the processor may detect a frequency band having a level equal to or greater than a predetermined value in the first frequency band (or high frequency band) above a predetermined cutoff frequency of the first sound signal.

Here, the frequency band having a level equal to or greater than the predetermined value in the first frequency band may be the frequency band of a fricative component represented by a pronunciation symbol such as [s] and [ʃ].

At step 740, the processor may generate harmonic signals h1 to hn including a plurality of frequency bins. The frequency bins may have a predetermined period in the frequency band and appear in a part or the whole of the frequency band. The signal level of each frequency bin may have the same level as the signal of the frequency band (fricative component) detected at step 720 or be substantially identical with a level having a tolerable difference. At step 740, the harmonic signals are generated as described with reference to FIG. 5B.

At step 750, the processor may overlap the harmonic signals with the first sound signal. At step 750, the signals may be overlapped as described with reference to FIG. 5C.

At step 760, the processor may adjust the level of at least one frequency bin of the high frequency band (or first frequency band) among the plural frequency bins included in the harmonic signals so as to be equal to the level of the first sound signal in the same frequency band. As a consequence, each frequency bin of the harmonic signal may be maintained as overlapped in the low frequency band below the cutoff frequency and may become equal to or lower than the level of the first sound signal as the original signal. At step 760, the second sound signal may be generated as described with reference to FIG. 5D.

At step 770, the processor may output the second sound signal generated based on the first sound signal to the sound output unit, which outputs the second sound signal.

Figure 8:
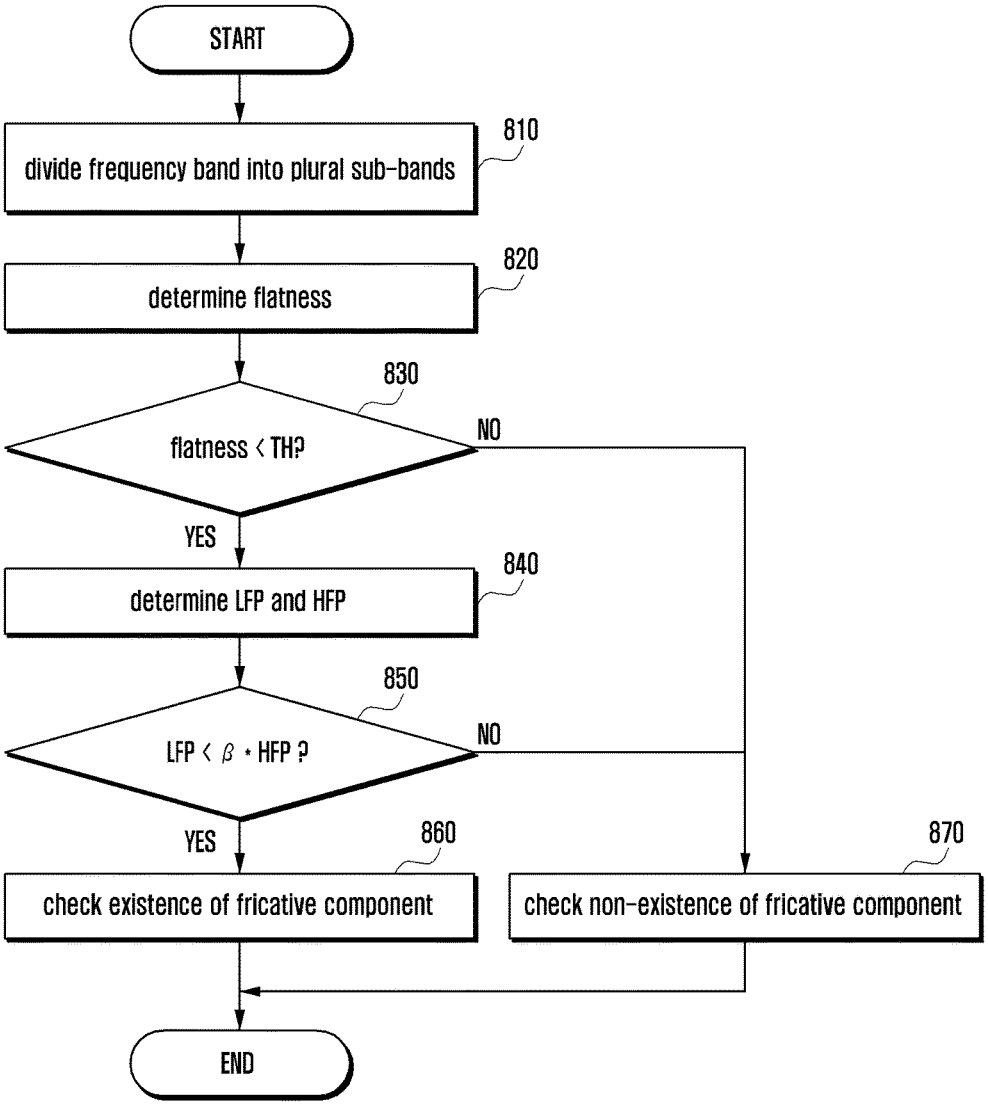
FIG. 8 is a flowchart illustrating an example fricative component detection method according to various example embodiments of the present disclosure.

FIG. 8 is a flowchart illustrating an example fricative component detection method according to various example embodiments of the present disclosure.

At step 810, the processor (e.g., processor 220 of FIG. 2 and processor 320 of FIG. 3) may divide a predetermined sensing band of sound signals at plural time points or time periods into a plurality of sub-bands. Here, the sensing band is a frequency band (e.g., frequency band between 4 kHz and 7 kHz) in which the fricative sounds [s] and [ʃ] are detected.

At step 820, the processor may determine a flatness per sub-band. The processor may calculate an arithmetic mean and a geometric mean using the signal level in each frequency sub-band at time t=t1, t=t2, and t=t3. The arithmetic mean and geometric mean of the nth sub-band may be calculated as (an+bn+cn)/3 and (an*bn*cn)^(⅓), respectively, where an, bn, and cn may denote mean values of the respective sub-bands (e.g., ∫(an/bandwidth of an))df).

At step 830, the processor may determine whether the flatness (e.g., ratio between the geometric mean and the arithmetic means) is less than a predetermined value (geometric mean/arithmetic mean ratio<α) and, if so, check for the presence of a fricative component in the corresponding sub-band. If not, the processor may check for non-presence of a fricative component at step 870. The fricative sound detection may be performed as described with reference to FIG. 4A.

At step 840, the processor may determine power values in the sensing band and a frequency band below the sensing band. The power value calculation may be performed as described with reference to FIG. 4B.

At step 850, the processor may determine whether the ratio between the power values of the sensing band (or high frequency band) and the frequency band below the sensing band (or low frequency band) is greater than a predetermined threshold value (HFP/LFP>β) and, if so, check for the presence of a fricative component at step 860.

According to various embodiments of the present disclosure, a sound signal correction method of an electronic device includes generating a first sound signal and acquiring a second sound signal by performing a predetermined signal processing on the first sound signal, wherein acquiring the second sound signal includes detecting a frequency band with a level equal to or greater than a predetermined value in a first frequency band above a predetermined cutoff frequency of the first sound signal, generating harmonic signals including a plurality of frequency bins that are identical in level with a signal in the detected frequency band, and overlapping the harmonic signals with the first sound signal.

According to various embodiments, the frequency bins include at least one frequency bin existing in a second frequency band below the cutoff frequency.

According to various embodiments, acquiring a second sound signal comprises adjusting the level of at least one frequency bin belonging to the first frequency band among the frequency bins included in the harmonic signals to the level of the first sound signal in the same frequency band.

According to various embodiments, acquiring the second sound signal includes dividing a predetermined sensing band of the first sound signal into a plurality of sub-bands, calculating flatness per sub-band and power values of the sensing band and a frequency band delimited below the sensing band, determining whether a fricative component exists in the first sound signal based on the flatness and power values, and performing, when a fricative component exists in the first sound signal, the signal processing.

According to various embodiments, determining whether the fricative component exists includes checking, when the flatness is less than a predetermined threshold value and a ratio between the power values of the sensing band and the frequency band delimited below the sensing band is greater than a predetermined threshold value, that the fricative component exists.

According to various embodiments, the sensing band is a frequency band between 4 kHz and 7 kHz.

According to various embodiments, the method further includes storing the cutoff frequency determined according to hearing characteristics of a user.

According to various embodiments, the method further includes outputting the second sound signal.

According to various embodiments, outputting the second sound signal includes generating the second sound signal by compensating the first sound signal for a user's hearing-impairment components in the first frequency band.

According to various embodiments, the electronic device is a hearing aid.

As described above, the electronic device and sound signal processing method of the present disclosure is advantageous in terms of improving the sound perception of a hearing-impaired user by processing a sound signal of an unperceivable frequency range of the hearing-impaired user digitally into a signal within the user's perceivable frequency range while minimizing and/or reducing the change of sound waveform.

What is claimed is:

1. An electronic device comprising:

a sound input unit comprising sound input circuitry configured to detect a sound and to convert the sound into a first sound signal; and a processor which is electrically connected to the sound input unit, the processor configured to receive the first sound signal and to perform a predetermined signal processing on the first sound signal to generate a second sound signal, wherein the signal processing comprises:

detecting a frequency band with a level equal to or greater than a predetermined value in a first frequency band above a predetermined cutoff frequency of the first sound signal;

generating harmonic signals including a plurality of frequency bins that are identical in level with a signal in the detected frequency band; and overlapping the harmonic signals with the first sound signal.

2. The electronic device of claim 1, wherein the frequency bins include at least one frequency bin in a second frequency band below the cutoff frequency.

3. The electronic device of claim 2, wherein the signal processing further comprises adjusting a level of at least one frequency bin belonging to the first frequency band among the frequency bins included in the harmonic signals to the level of the first sound signal in the same frequency band.

4. The electronic device of claim 1, wherein the processor is configured to perform a determination of whether a fricative component exists in the first sound signal and to perform, when a fricative component exists in the first sound signal, the signal processing, wherein the determination of whether a fricative component exists comprises:

dividing a predetermined sensing band of the first sound signal into a plurality of sub-bands; and determining a flatness per sub-band and power values of the sensing band and a frequency band delimited below the sensing band.

5. The electronic device of claim 4, wherein the processor is configured to check, when the flatness is less than a predetermined threshold value and a ratio between the power values of the sensing band and the frequency band delimited below the sensing band is greater than a predetermined threshold value, whether the fricative component is present.

6. The electronic device of claim 5, wherein the sensing band is a frequency band between 4 kHz and 7 kHz.

7. The electronic device of claim 1, further comprising a memory for storing the cutoff frequency determined based on hearing characteristics.

8. The electronic device of claim 1, further comprising a sound output unit comprising sound output circuitry electrically connected to the processor and configured to output the second sound signal.

9. The electronic device of claim 8, wherein the processor is configured to control the sound output unit to output the second sound signal acquired by compensating the first sound signal for hearing-impairment components in the first frequency band.

10. A sound signal correction method of an electronic device, the method comprising:

acquiring a first sound signal; and generating a second sound signal by performing predetermined signal processing on the first sound signal, wherein generating the second sound signal comprises:

detecting a frequency band with a level equal to or greater than a predetermined value in a first frequency band above a predetermined cutoff frequency of the first sound signal;

generating harmonic signals including a plurality of frequency bins that are identical in level with a signal in the detected frequency band; and overlapping the harmonic signals with the first sound signal.

11. The method of claim 10, wherein the frequency bins include at least one frequency bin in a second frequency band below the cutoff frequency.

12. The method of claim 11, wherein generating a second sound signal further comprises adjusting a level of at least one frequency bin belonging to the first frequency band among the frequency bins included in the harmonic signals to the level of the first sound signal in the same frequency band.

13. The method of claim 10, wherein generating the second sound signal further comprises:

determining whether a fricative component is present in the first sound signal; and performing, when a fricative component is present in the first sound signal, signal processing comprising:

dividing a predetermined sensing band of the first sound signal into a plurality of sub-bands; and determining a flatness per sub-band and power values of the sensing band and a frequency band delimited below the sensing band.

14. The method of claim 13, wherein determining whether the fricative component is present comprises checking, when the flatness is less than a predetermined threshold value and a ratio between the power values of the sensing band and the frequency band delimited below the sensing band is greater than a predetermined threshold value, that the fricative component is present.

15. The method of claim 14, wherein the sensing band is a frequency band between 4 kHz and 7 kHz.

16. The method of claim 10, further comprising storing the cutoff frequency determined based on hearing characteristics.

17. The method of claim 10, further comprising outputting the second sound signal.

18. The method of claim 17, wherein outputting the second sound signal comprises generating the second sound signal by compensating the first sound signal for hearing-impairment components in the first frequency band.

19. The method of claim 17, wherein the electronic device is a hearing aid.

20. A non-transitory computer-readable storage medium storing program instructions executed for performing the method of claim 10.

* * * * *